US009555312B2

(12) United States Patent
Machado

(10) Patent No.: US 9,555,312 B2
(45) Date of Patent: Jan. 31, 2017

(54) HYBRID BATTING AND SLIDING GLOVE

(71) Applicant: Joseph Machado, Fall River, MA (US)

(72) Inventor: Joseph Machado, Fall River, MA (US)

( * ) Notice: Subject to any disclaimer, the term of this patent is extended or adjusted under 35 U.S.C. 154(b) by 0 days.

(21) Appl. No.: 14/742,841

(22) Filed: Jun. 18, 2015

(65) Prior Publication Data

US 2016/0354673 A1 Dec. 8, 2016

Related U.S. Application Data

(60) Provisional application No. 62/014,117, filed on Jun. 19, 2014.

(51) Int. Cl.
*A63B 71/14* (2006.01)
*A41D 19/00* (2006.01)

(52) U.S. Cl.
CPC ..... *A63B 71/143* (2013.01); *A41D 19/00* (2013.01)

(58) Field of Classification Search
CPC ... A63B 71/14; A63B 2209/10; A63B 71/143; A63B 71/141; A63B 71/146; A63B 71/148; A63B 2069/0008; A63B 2102/14; A63B 21/4017; A63B 21/4019; A63B 2243/00; A63B 2243/0025; A63B 2243/007; A63B 69/0002; A41D 19/01547; A41D 19/01558; A41D 19/01582; A41D 13/088; A41D 19/01564; A41D 13/081; A41D 13/087; A41D 19/00
See application file for complete search history.

(56) References Cited

U.S. PATENT DOCUMENTS 1,271,110 A * 7/1918 Zeigler ..... A41D 19/01 2/158
1,612,055 A * 12/1926 Rice ..... A41D 19/002 2/160
4,042,977 A * 8/1977 Antonious ..... A41F 1/06 2/16
4,447,912 A * 5/1984 Morrow ..... A61F 13/104 2/159
4,565,195 A * 1/1986 Eisenberg ..... A41D 19/01588 2/16
4,654,895 A * 4/1987 Peters ..... A41D 19/0017 2/161.1
4,691,387 A * 9/1987 Lopez ..... A41D 19/01547 2/159
4,768,234 A * 9/1988 Yamamoto ..... A41D 19/01523 2/16
4,791,683 A * 12/1988 Agee ..... A41D 19/0034 2/159
4,793,005 A * 12/1988 Hetzel, Jr. ..... A41D 19/01547 2/161.1
4,863,084 A * 9/1989 Nabozny ..... A41D 19/0068 2/161.6
4,905,321 A * 3/1990 Walunga ..... A63B 71/141 2/160

(Continued)

*Primary Examiner* — Bobby Muromoto, Jr.
(74) *Attorney, Agent, or Firm* — Jerome E Sacks

(57) ABSTRACT

This invention presented herein is a hybrid batting and sliding glove that will reduce the number of hand injuries associated with sliding head first into a base in the sports of baseball and softball. There are three key features. The Tendon Feature gently pulls the hand back keeping the fingers off the ground and into a safer position for sliding. The wrist closure feature keeps the wrist from hyperextending. The figure feature component keeps the fingers together.

7 Claims, 5 Drawing Sheets

(56) References Cited

U.S. PATENT DOCUMENTS 5,184,815 A * 2/1993 Maddox ..... A63B 69/0002 2/161.1
5,226,190 A * 7/1993 Lynch ..... A63B 71/148 2/160
5,404,591 A * 4/1995 Brinnand ..... A41D 13/088 2/161.1
5,435,273 A * 7/1995 Landis ..... A01K 27/005 119/795
5,740,555 A * 4/1998 Renegar ..... A41F 1/06 2/161.1
5,809,569 A * 9/1998 Bruno ..... A41D 19/0034 2/158
5,848,440 A * 12/1998 Pajarola ..... A41D 19/01582 2/159
6,757,915 B2 * 7/2004 Sidlo ..... A63B 71/14 2/16
6,912,732 B2 * 7/2005 Hatch ..... A41D 19/01558 2/16
7,043,762 B2 * 5/2006 Greenhalgh ..... A63B 71/14 2/16
7,107,623 B2 * 9/2006 Hatch ..... A41D 19/01558 2/161.5
8,205,269 B2 * 6/2012 Anderson ..... A63B 71/146 2/161.2
9,055,774 B2 * 6/2015 Gambordella ... A41D 19/01547
2003/0217403 A1 * 11/2003 Hatch ..... A41D 19/01558 2/161.1
2004/0010834 A1 * 1/2004 Sidlo ..... A63B 71/14 2/16
2004/0244088 A1 * 12/2004 Greenhalgh ..... A63B 71/14 2/16
2005/0183184 A1 * 8/2005 Hatch ..... A41D 19/01558 2/161.1
2008/0196135 A1 * 8/2008 Gait ..... A41D 19/01588 2/21
2008/0282445 A1 * 11/2008 Taliento ..... A41D 19/01523 2/161.3
2011/0041235 A1 * 2/2011 Harris ..... A41D 19/01582 2/161.1
2011/0113521 A1 * 5/2011 Bradford ..... A41D 19/01582 2/19
2012/0144544 A1 * 6/2012 Telfer ..... A41D 19/0041 2/20
2012/0204319 A1 * 8/2012 Gambordella ... A41D 19/01547 2/161.1
2014/0259258 A1 * 9/2014 Miranda ..... A63B 71/143 2/20

* cited by examiner

HYBRID BATTING AND SLIDING GLOVE

CROSS-REFERENCE TO RELATED APPLICATIONS

This application claims the benefit of the U.S. Provisional Patent Application No. 62/014,117 filed Jun. 19, 2014 by the present inventor. This provisional patent application is incorporated herein by reference.

BACKGROUND OF THE DISCLOSURE

There exists many gloves designed to be used in sporting events. A particular type of glove is common among baseball and softball players that are worn when at bat or on base. Some sports gloves have specific features designed to address a particular problem, U.S. Pat. No. 5,226,190 issued 1993 Jul. 13, is designed to protect the hand when a base runner is sliding. U.S. Pat. No. 5,528,772, issued in 1996-06-25, is an inner glove-like device designed to be worn inside another conventional glove to protect the hand by providing padding. Additional gloves, often used for other sports such as motorcycling or golf, also have features that may apply to the baseball and softball. However there is a need for a baseball or softball glove that protects the batter when at bat or sliding, and yet is easy to manufacture and use.

SUMMARY OF THE DISCLOSURE

The embodiments of the invention presented herein is a hybrid batting and sliding glove that will reduce the number of hand injuries associated with sliding head first into a base in the sports of baseball and softball. There are three key features. The first feature, called the Tendon Feature is designed to gently pull the hand back keeping the fingers off the ground and into a safer position for sliding. The second feature is the wrist closure strap that will keep the wrist from hyperextending. The third feature, called the Finger Feature component, is designed for keeping the fingers together.

NUMBER PART NAMES

Figure 1:
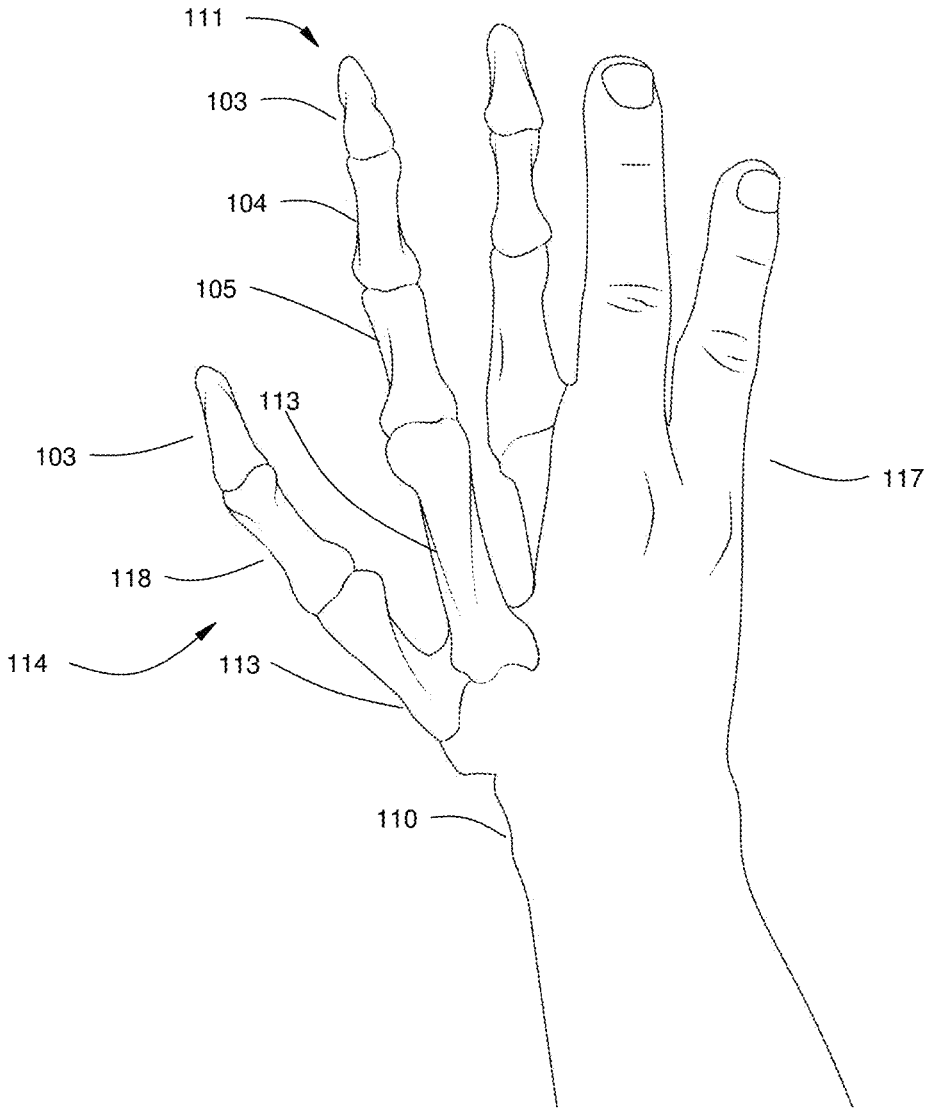
FIG. 1 is a picture of a hand with parts shown.

102 finger elastic band
103 distal phalanx
104 intermediate phalanx
105 proximal phalanx
106 wrist closure strap
107 glove
108 thumb elastic band
109 crisscross patterned stitching
110 wrist
111 finger
112 glove palm
113 metacarpal
114 thumb
116 pocket
117 pinkie finger metacarpal
118 thumb intermediate proximal phalanx

**118*a*** first hook
**118*b*** first loop
**120*a*** second hook
**120*b*** second loop
**122*a*** third hook
**122*b*** third loop
**124*a*** fourth hook
**124*b*** fourth loop
128 finger feature component

DETAILED DESCRIPTION OF THE DISCLOSURE

In the detailed description and the related claims the term fingers refer to the four digits of the hand, other than the thumb. In FIG. 1 and the remaining figures, only one of the four fingers is shown with numerals and lead lines. Similarly only one of the four glove finger components may have numerals and lead lines. When a hand part, e.g. intermediate phalanx 104 or proximal phalanx 105 is referred to in FIGS. 2 through 5, the locations are indicated in FIG. 1.

FIGS. 1 through 5 illustrate the first embodiment of the present invention. FIG. 1 illustrates the anatomy of the hand and the glove parts used in the remaining figures. The four fingers 111 each have a distal phalanx 103, an intermediate phalanx 104, a proximal phalanx 105, and a metacarpal 113. The thumb 114 has a distal phalanx 103, a metacarpal 113, and a thumb intermediate proximal phalanx 118. The hand has a wrist 110.

Figure 2:
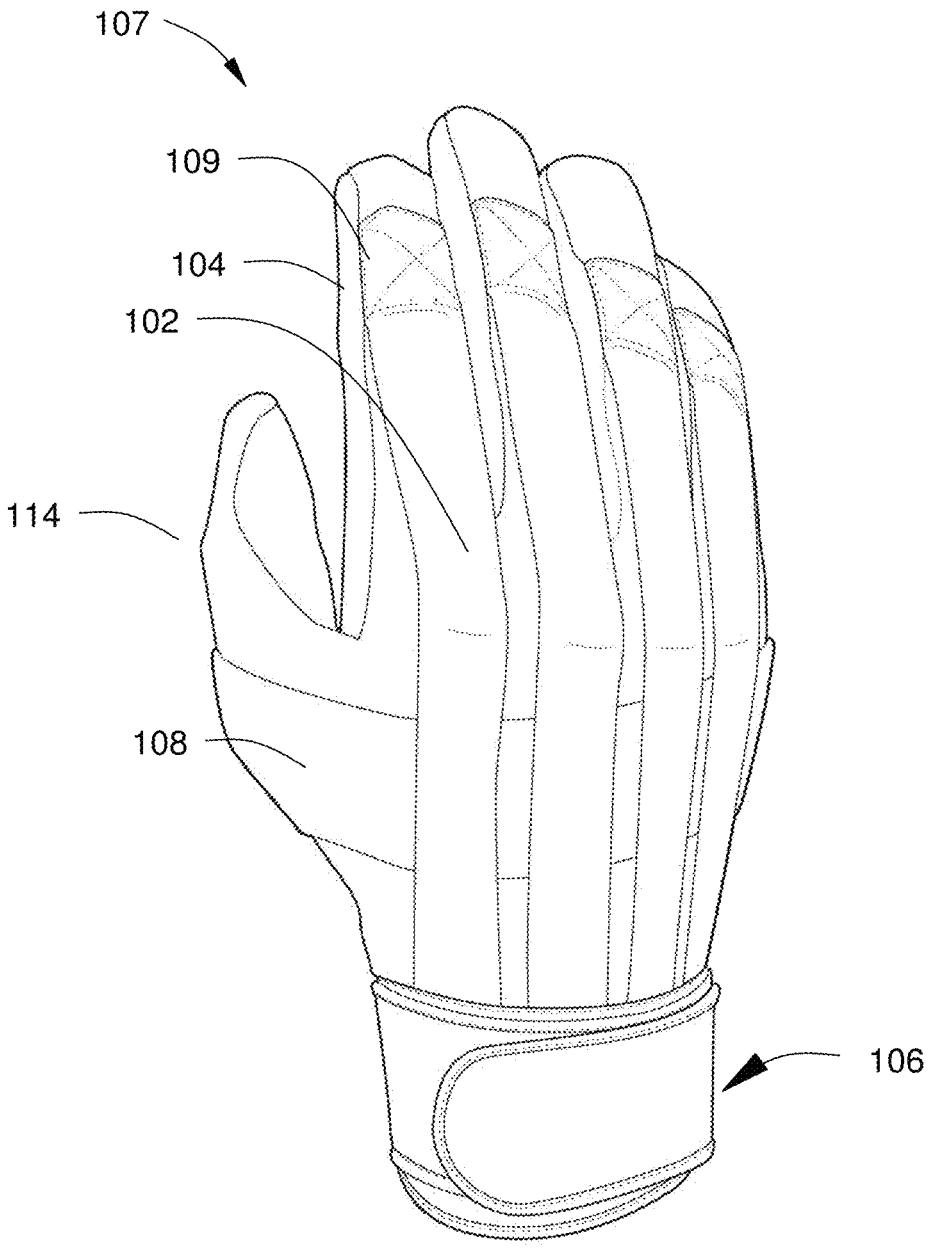
FIG. 2 illustrates the posterior side of the glove.

FIG. 2 shows the posterior side of the glove 107. Referring to FIG. 2, four finger elastic bands 102 being sewn on the glove fingers of the glove 107. The finger elastic bands are sewn at the intermediate phalanx 104 and the wrist 110. The attachment of the four finger elastic bands 102 at the intermediate phalanx 104 of each finger is done by sewing four 1 inch square crisscross patterned stitching 109 (only one of the four 1 inch square crisscross patterned stitching 109 is enumerated in the figure). The crisscrossed stitching are designed to protect the fingers. The attachment of the finger elastic bands 102 at the wrist is done by sewing them to the glove, positioned under the wrist closure strap 106. The finger elastic bands 102 are cut two inches shorter than the distance from the intermediate phalanx 104 to the wrist 110 so that when stretched it will provide resistance when worn. A thumb elastic band 108 one and half inch wide is used in conjunction with the thumb 114. It wraps around the glove 107 and will be sewn at pinkie finger metacarpal 117 (see FIG. 1) and at the thumb intermediate proximal phalanx 118 (see FIG. 1). The four finger elastic bands 102 and the thumb elastic band 108 are designed and configured to stretch to allow the batter full range of motion in the fingers while batting and then retract placing the fingers up off the ground while sliding.

Figure 3:
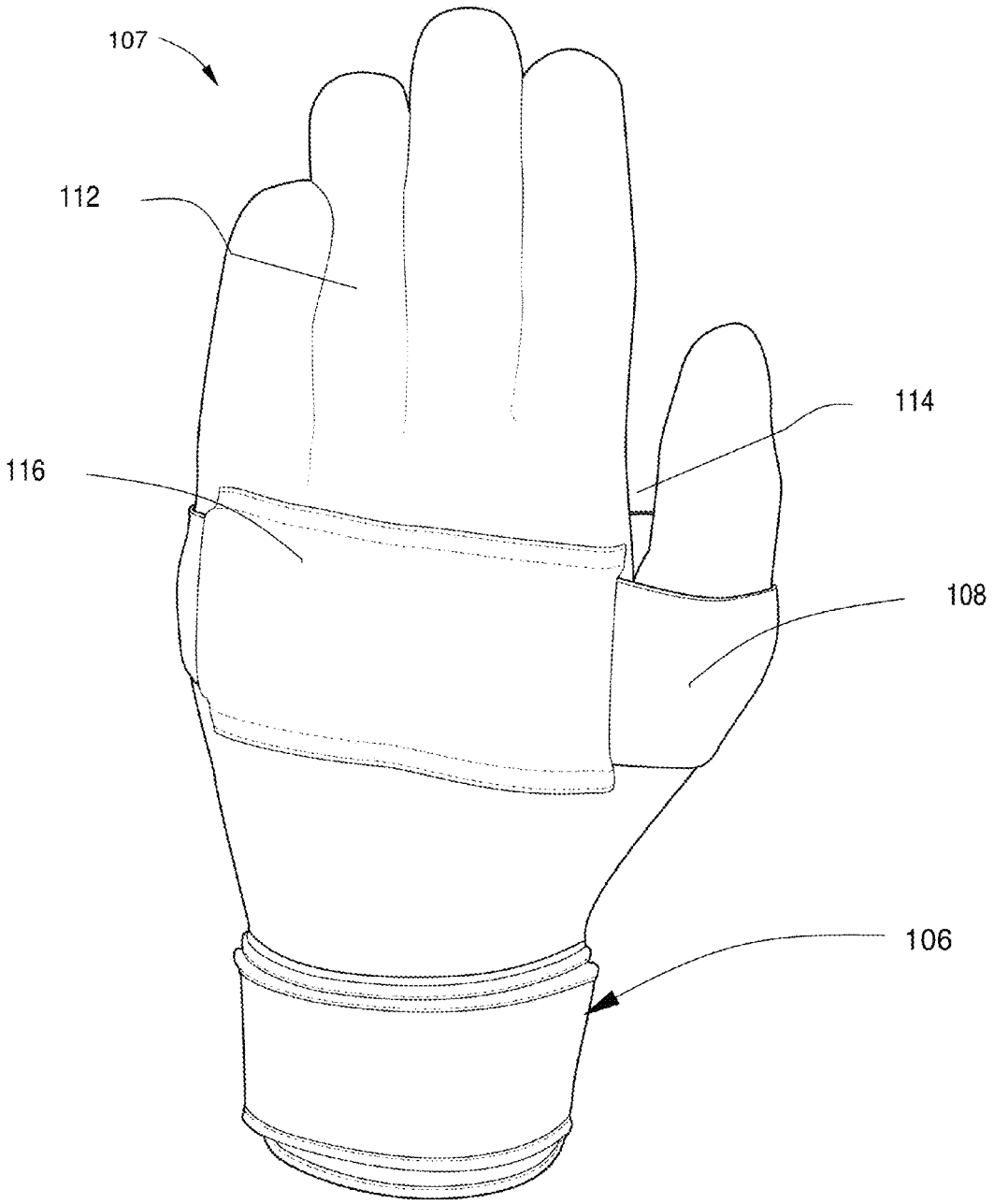
FIG. 3 illustrates the anterior side of the glove.
Figure 4:
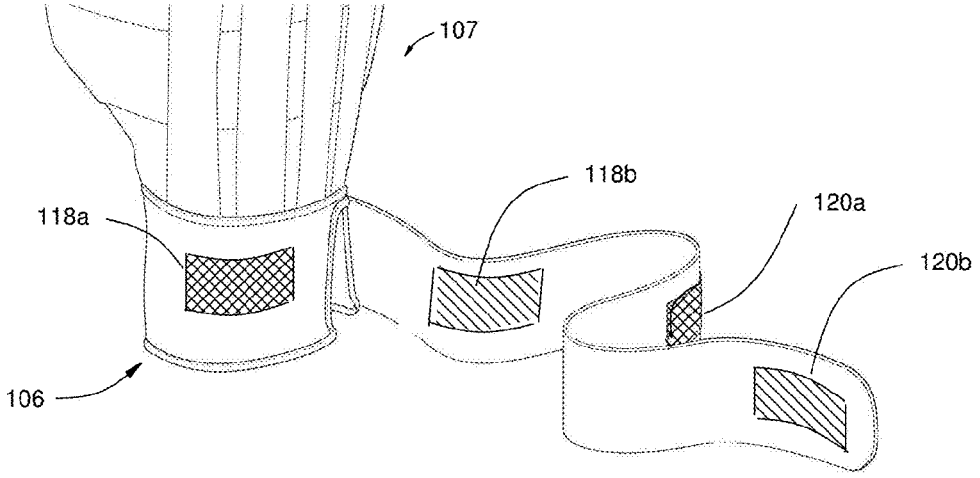
FIG. 4 illustrates the wrist closure strap.

FIG. 3 illustrates the anterior side of the glove 107. The thumb elastic band 108 is covered by a pocket 116 using the same material as the glove's palm 112 (glove palm not enumerated in FIG. 3). This pocket 116 is designed and configured to ensure proper grip on the bat while batting.

FIGS. 2 and. 4 show the wrist closure strap 106 designed to prevent hyperextension of the wrist. This wrist closure strap 106 is two inches wide and is dimensioned to wrap around the wrist twice and fasten on the posterior side of the wrist. Two separate closures made from hook and loop tape are placed on the posterior side of the wrist. A one inch wide by two inch length first hook **118*a* and first loop 118*b* pair are sewn between the first and second revolution, and a one inch wide by two inch long second hook 120***a* and second loop 120*b* pair is used for the final closure.

Figure 5:
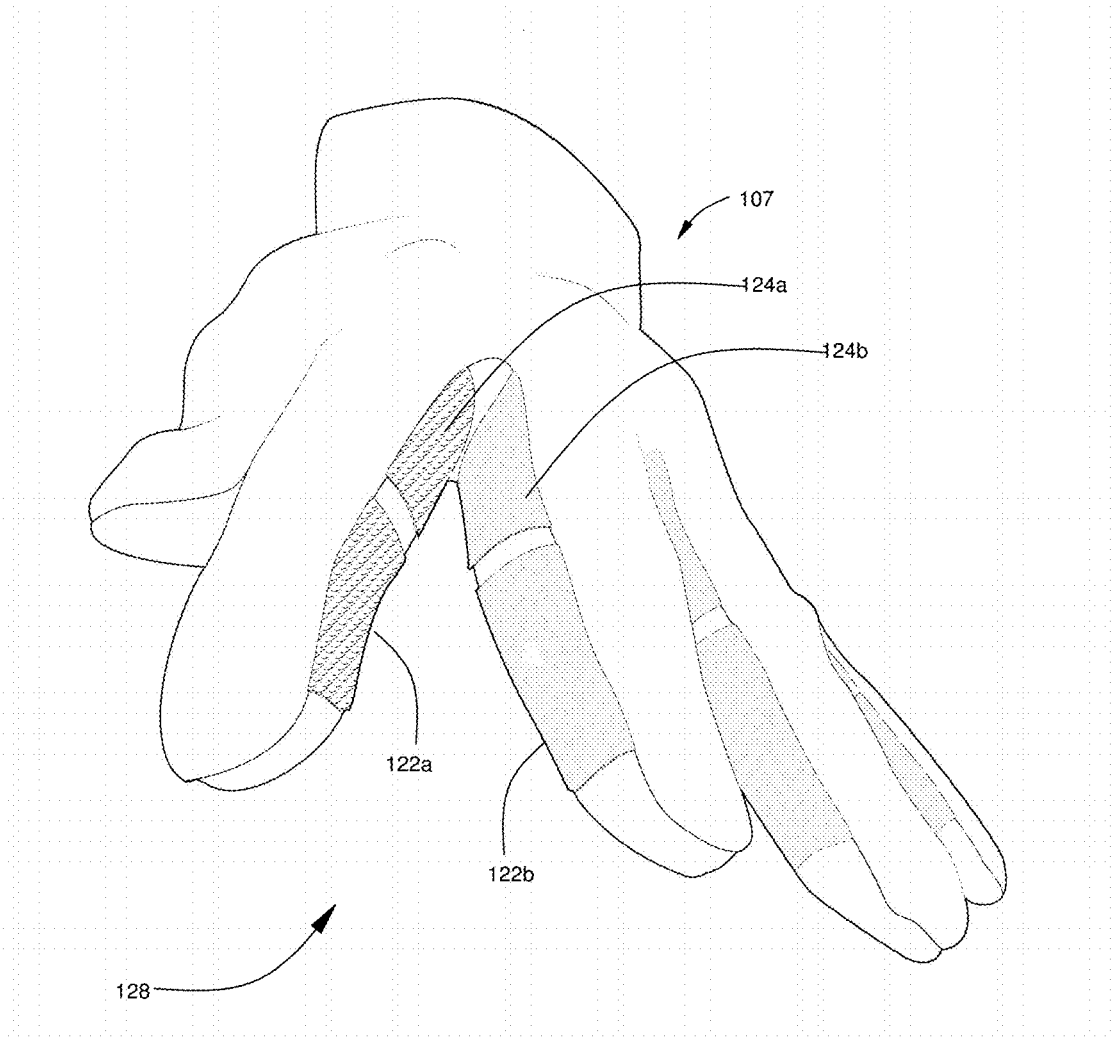
FIG. 5 illustrates the finger feature component.

FIG. 5 illustrates the finger feature component 128. This finger feature component 128, consists of three hook and loop sets, one set placed between each of the three adjacent finger pairs. The finger feature component 128 keeps the fingers together, preventing a finger injury caused by a finger getting caught on anything/anyone while sliding head first. FIG. 5 illustrates the hook and loop sets for the pointer finger and middle finger. It is constructed from the a third hook 122*a* and third loop 122*b* pair and a fourth hook 124*a* and fourth loop 124*b* pair to the area of the glove 107 between adjacent fingers, positioned as shown in FIG. 5. (Only the first of the three pairs are enumerated in FIG. 5). The hook and loop tape placement is designed and configured to coincide with the intermediate phalanx 104 and proximal phalanx 105 of each finger.

Additional embodiments are consistent with the first embodiment presented herein. The glove 107 may come in various sizes and the size of the parts and components of the first embodiment may vary in alternate embodiments. The position of the parts and component's may vary from those indicted in the first embodiment, as long as they perform an equivalent function. The attachment method of the hook and loop parts may be glued or attached to the glove 107 by means other than sewing.

The disclosure presented herein gives multiple embodiments of the present invention. These embodiments are to be considered as only illustrative of the invention and not a limitation of the scope of the present invention. Various permutations, combinations, variations, and extensions of these embodiments are considered to fall within the scope of this invention.

I claim:

1. A hybrid batting and sliding glove for use by a batter in sports, especially softball and baseball comprising a glove having four glove fingers and a glove thumb;

four finger elastic bands, each sewn along length of one of said four glove fingers on the posterior side of said glove, each of said four finger elastic bands sized and configured so that when glove fingers bend, each of said four finger elastic bands provide resistance;

a thumb elastic band, said thumb elastic band being passing around said glove thumb, passing over palm of said glove and passing over posterior of said glove forming a loop; said thumb elastic band attached to said glove;

a pocket, said pocket being slidingly wrapped around said thumb elastic band on anterior side of said glove, said pocket sized and configured to provide a grip for said batter when batting; and a wrist closure strap, said wrist closure strap, designed an configured to wrap around wrist of said glove;

a finger feature component comprised of three hook and loop sets, each hook and loop set being positioned between adjacent said glove fingers, said finger feature component sized and configured to keeps said glove fingers together preventing a finger injury caused by finger of said batter getting caught on anything/anyone while sliding head first.

2. The hybrid batting and sliding glove of claim 1 wherein said each of said four finger elastic bands have an approximately one inch width, and are cut two inches shorter than distance from intermediate phalanx to the wrist configured so that when stretched it will provide resistance when worn.

3. The hybrid batting and sliding glove of claim 1 wherein said thumb elastic band is approximately one and half inch wide and is be attached to said glove at pinkie finger metacarpal and at intermediate proximal phalanx of said glove thumb.

4. The hybrid batting and sliding glove of claim 1 wherein said thumb elastic band is one and half inch wide and is attached to pinkie finger metacarpal and at thumb intermediate proximal phalanx.

5. The hybrid batting and sliding glove of claim 1 wherein four crisscross patterned stitching being located on each of said four glove fingers, each of said four crisscross patterned stitching being sewn onto one of each finger elastic bands in a crisscross pattern located at intermediate phalanx of each glove finger.

6. The hybrid batting and sliding glove of claim 1 wherein said wrist closure strap being two inches wide and is dimensioned to wrap around the wrist twice and fasten on the posterior side of the wrist;

and wherein a one inch wide by length of two inch first hook loop pair being sewn between first and second revolution, while a two inch by two inch second hook and loop pair is used for final closure.

7. The hybrid batting and sliding glove of claim 1 wherein said finger feature component being comprised of said three hook and loop sets, each of said hook and loop set comprised of two loop and loop pairs positioned between adjacent said glove fingers.

* * * * *